US005671625A

United States Patent [19]

Barbe et al.

[11] Patent Number: 5,671,625

[45] Date of Patent: Sep. 30, 1997

[54] SHAPING OF THIN METAL PRODUCTS BETWEEN TWO ROLLS

[75] Inventors: Jacques Barbe; François Mazodier, both of St-Etienne; Luc Vendeville; Pierre Delassus, both of Bethune; Elias Sarkis, Paris; Yves Grandgenevre, Lorrent Fontes; Jean-Marie Pelletier, Bethune, all of France

[73] Assignees: Usinor-Sacilor (Sciete Anonyme), Puteaux, France; Thyssen Stahl Aktiengesellschaft, Duisburg, Germany

[21] Appl. No.: 549,603

[22] Filed: Oct. 27, 1995

[30] Foreign Application Priority Data

Oct. 28, 1994 [FR] France ..... 94 13102

[51] Int. Cl.[6] ..... B21B 37/00

[52] U.S. Cl. ..... 72/10.7; 72/14.1; 72/366.2

[58] Field of Search ..... 72/10.7, 8.1, 10.1, 72/13.4, 13.7, 14.1, 366.2, 365.2; 164/151.2; 33/657

[56] References Cited

U.S. PATENT DOCUMENTS 3,358,485 12/1967 De Caro et al. ..... 72/21

4,131,004 12/1978 Eibe ..... 72/10.7

5,317,386 5/1994 Marcus et al. ..... 356/372

OTHER PUBLICATIONS

Japan Abstract, vol. 10, No. 249, Aug. 1986; JP–A–61 078 537, Apr. 1986.

Japan Abstract, vol. 16, No. 51, Feb. 1992; JP–A–90 051 431, Nov. 1991.

Japan Abstract, vol. 15, No. 101, Mar. 1991; JP–A–89 136 445, Jan. 1991.

*Primary Examiner*—Lowell A. Larson
*Assistant Examiner*—Ed Tolan
*Attorney, Agent, or Firm*—Nilles & Nilles, S.C.

[57] ABSTRACT

The device includes two rolls (10, 11) held by bearings (13, 14) on a frame (16) and, for each roll, devices (22) for measuring the position of the generatrix diametrically opposite the neck between the rolls, at three or more points lying respectively in a mid-plane ($P_3$) perpendicular to the axes and in secondary planes such as (P1, P5) parallel to the mid-plane, and means (23) for measuring, in the said mid-plane, the position of a generatrix lying at 90° to the neck. The method according to the invention uses these measurements to determine continuously the gap between the rolls, taking into account the in-service deformations of the rolls.

16 Claims, 3 Drawing Sheets

SHAPING OF THIN METAL PRODUCTS BETWEEN TWO ROLLS

BACKGROUND OF THE INVENTION

1. Field of the Invention

The present invention lies within the field of the manufacture of metal products, generally of flat shape and thin, such as strips of steel or other metals, by shaping the product as it passes between two rolls which have substantially parallel axes and, which exert a compressive force on the product.

It applies more particularly to the twin-roll continuous casting of metals and alloys, during which a large amount of heat is exchanged between the cast metal and the vigorously cooled rolls which constitute two walls of the mould receiving the molten metal, and also applies to other shaping processes, for example rolling.

2. Discussion of the Related Art

One of the major problems in obtaining a quality product is that of knowing the roll gap virtually all the time, in order to be able to act on thickness and crown controls to allow a product of good geometrical quality to be obtained, that is to say one having a cross-section of the desired and constant shape and size along the length of the product.

The expression "roll gap" will therefore denote hereafter not only the average distance separating the rolls at the neck between them (the narrowest passage lying in the plane common to the axes of the two rolls), but also the shape of the passage at the neck, which, in general, is not exactly rectangular, either intentionally, with the aim of obtaining a product having a slight transverse crown, or as a result of deformations in the installation and in the rolls.

These deformations result from the forces exerted by the product, which cause:

- separation of the rolls through spring in their support stand or by retraction of the means for positionally adjusting their bearings (these variations in separation, moreover, not necessarily being identical on both sides of the rolls, which leads to a dissymmetry in the gap with respect to the mid-plane perpendicular to the axes of the rolls);
- bending of the shafts of the rolls;
- or even inherent bending of the wall of the rolls.

These deformations also arise from the heat exchange which causes a general thermal crown effect on the rolls as they heat up and also cyclic local deformations as the rolls rotate, these being due to the successive contacting and separation of each zone of the roll with the product formed, especially in the case casting between rolls, the cast product solidifying on contact with the rolls.

In order to know the shapes and dimensions of this gap as accurately as possible, it was therefore necessary to measure the separation at the neck between the rolls, not just at one point over the width of the rolls but over this entire width, or at least at several points along two generatrices forming the neck.

As it is not possible to make these measurements during the casting operation, it is already known to use thickness and profile gauges enabling the shapes and dimensions of the product to be determined after it has been shaped. In addition to the problem of the cost of these gauges, they can in practice be placed only far from the neck and the measurement made therefore reflects the value of the gap only after a relatively long delay. Should this value drift, the correction can therefore only be made belatedly, which leads to irregularities along the longitudinal profile of the manufactured product.

Objects and Summary of the Invention

The object of the invention is to solve these problems and its purpose is particularly to enable the gap to be determined rapidly, continuously during the operation of shaping the product, so as to be able to act virtually instanteously on the members for adjusting the position of the rolls, or on the members for controlling other parameters of the shaping operation, in order to keep a constant gap of the required shape and dimensions, for example on the means for controlling the "crown" of the roll.

With these objectives in mind, the subject of the invention is a method of continuously determining the gap at the neck between two rolls, having substantially parallel axes, of an installation for the hot-shaping of a thin metal product by passing the product between the rolls, characterized in that the value of the gap at the centre, that is to say in a transverse mid-plane of the installation, is measured in an initial state without the product and when cold and, during shaping of the product, and for each roll:

- the variations, with respect to this initial state, in the position of at least three points on the surface of the roll are measured along a generatrix lying at 180° to the neck, that is to say diametrically opposite the neck, these points lying respectively at least in the mid-plane and in two secondary planes parallel to the mid-plane and lying on either side of the said mid-plane;
- the variation, with respect to this initial state, in the position of a point lying on a generatrix at 90° to the neck is measured, at least in the mid-plane;
- the variations in the length of the radius of the roll in the planes, between the neck and one of the 90° or 180° locations, is determined using a computer model or using experimental curves;
- using the measurements of the variations in position of the points in the mid-plane, these lying respectively at 90° and 180° with respect to the neck, and the variation in the length of the radius in this mid-plane respectively, on the one hand, between the neck and the 90° location and, on the other hand, between the 90° and 180° locations, the value of the roll spring at the centre and the value of the variation in the length of the radius at the neck with respect to the initial state are computed therefrom;
- and computed therefrom, using the value of the gap at the centre when cold, the value of the roll spring at the centre and the value of the variation in the length of the radius, is the instantaneous value of the gap at the centre, as well as the profile of the gap.

Therefore, by virtue of the method according to the invention, it is thus possible to know accurately and rapidly, and continuously during the manufacture of the product, the virtually precise dimensions and shapes of the gap, and therefore to ensure that these dimensions and shapes remain within the required tolerances, or, should a drift occur, to correct it virtually instantaneously by means of the various actuators which conventionally equip such an installation. It is thus possible to obtain a quality product of constant cross-section over its entire length.

Preferably, the variations in the position of the points on the surface which lie in the secondary planes and at 90° to the neck are also measured. The dissymmetry of the gap, that is to say the difference in separation of the rolls between their two edges, may then be determined precisely using the measurement of the variations in position of the points lying respectively in the said secondary planes and in the said 90° and 180° locations.

Also preferably, the thermal profile of a generatrix remote from the neck, and at a location where the variations in position of at least three points of this generatrix are measured, is determined using a parametrized function defining the thermal deformation at a point on the generatrix as a function of the axial position of this point and using the measurements of the variations in the position of the at least three points, and the thermal profile of the generatrix at the neck is determined using the thermal profile of the generatrix remote from the neck and the determination of the variations in the length of the radius of the roll in the said planes, between the neck and the location of the generatrix remote from the neck.

The subject of the invention is also a device for shaping thin metal products, such as strips, which includes two rolls, having substantially parallel axes, defining between them a neck lying in the common plane of their axes, supporting means provided with bearings in which axial ends of the shafts of the said rolls rotate, and a frame on which the means for supporting at least one of the rolls are guided and can move translationally in a direction in which the rolls are moved closer together or further apart.

According to the invention, this device is characterized in that it includes, for each roll, means for measuring the position of the generatrix diametrically opposite the neck, at three points lying respectively in a mid-plane perpendicular to the axes and in two secondary planes parallel to the mid-plane and lying near the edges of the rolls and means for measuring the position, in the said mid-plane, of a generatrix lying at 90° to the neck.

Preferably, in order to be able to measure the dissymmetry of the gap precisely, the device also includes means for measuring the position, in the secondary planes, of the said generatrix lying at 90° from the neck.

According to an embodiment variant, the measurement means are position sensors attached to the means for supporting the rolls, and the device furthermore includes means for measuring the variations in the separation of the bearings.

According to another variant, which makes it possible to dispense with means for measuring the separation of the bearings, the means for measuring the position of the generatrix diametrically opposite the neck are sensors attached to the frame.

The device also includes computation means connected to the measurement means for:

- computing the variations in the measured positions of the generatrices;
- determining, by means of a computer model taking into account the casting parameters and/or using experimental data, the variations in the length of the radius of the roll in the planes between the neck and one of the 90° or 180° locations;
- computing, using the said position variations and the said variations in length of the radius, the value of the roll spring at the centre and the value of the variation in the length of the radius at the neck with respect to the initial state;
- and deducing therefrom the instantaneous value of the gap at the centre, as well as the profile of the gap, using the value of the gap at the centre when cold and the value of the roll spring at the centre and the value of the variation in the length of the radius.

Other characteristics and advantages will appear in the description which will be given of a device for the continuous casting of thin steel strips between rolls, in accordance with the invention, and of a method of continuously determining the gap between the casting rolls.

BRIEF DESCRIPTION OF THE DRAWINGS

Reference will be made to the appended drawings in which.

DETAILED DESCRIPTION OF THE PREFERRED EMBODIMENT

Figure 1:
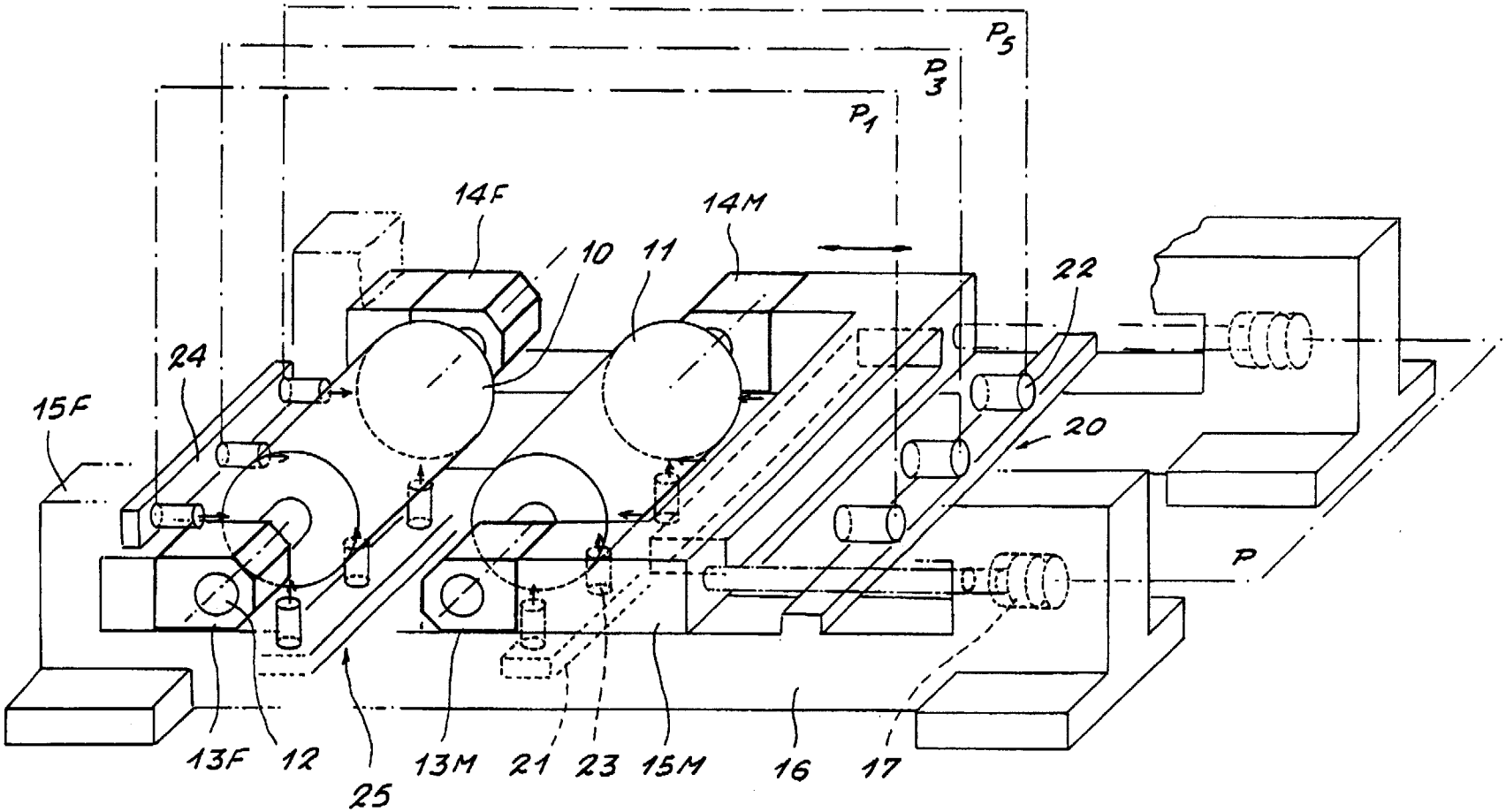
FIG. 1 is a simplified partial representation of the casting device.

The continuous-casting device shown in FIG. 1 includes, in a known manner, two rolls 10, 11, having parallel axes and lying in a horizontal plane P, which are internally cooled and rotationally driven by drive means, not shown. Such a roll is shown in a simplified manner in the drawing of FIG. 2 and includes a shaft 12, a body 31 connected to the shaft, and an external shell 32 which constitutes the casting surface and which is held on the body 31 by means known per se.

Conventionally, in order to obtain a strip having a slight transverse crown (necessary for the subsequent cold-rolling treatments of the strip), an external surface 34 of the shell 32 must be slightly "hollowed". This is why the longitudinal profile (along the axis of the roll) of this surface, obtained by machining, is concave. Moreover, this concavity is determined when cold so that the desired "hollow" at the neck remains when hot, bearing in mind the fact that the initial concavity tends to be reduced by the thermal crown effect as the shell heats up.

Figure 2:
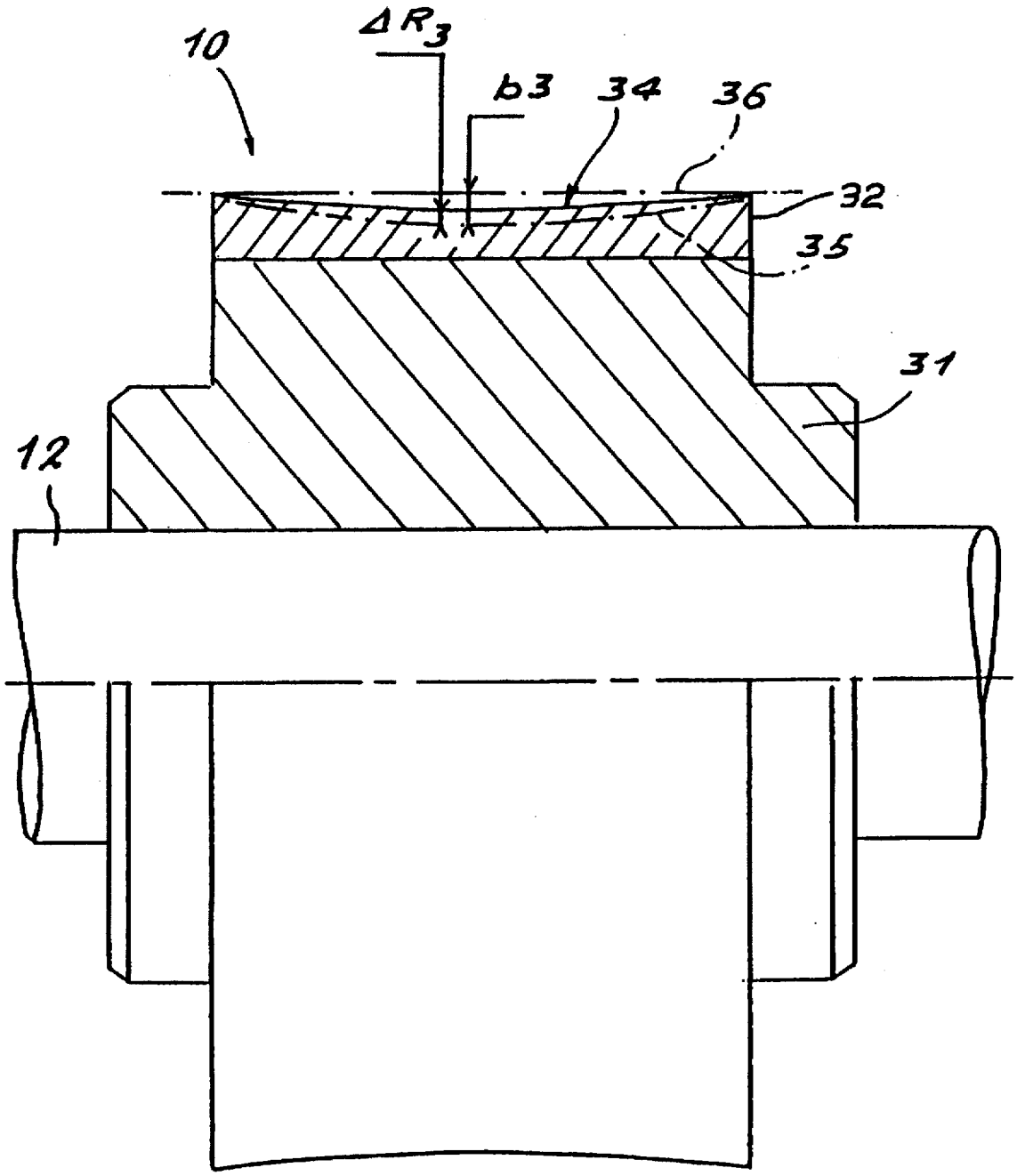
FIG. 2 is an axial half-sectional view of a roll equipping this device.

FIG. 2 shows, in an intentionally exaggerated manner, the shapes of the surface of the shell 32, when cold, by the dotted line 35 and when hot by the reference 34, the line 36 representing a theoretical rectilinear generatrix with respect to which the hollow, or the concavity, is defined.

Returning to FIG. 1, it may be seen that the shafts 12 are held in bearings 13F, 13M, 14F, 14M, or chocks, in which they rotate.

The bearings 13F, 14F of the roll 10 are connected by support means, for example a cross-piece 15F which is fixed with respect to the frame 16 of the device. The bearings 13M, 14M of the other roll 11 are connected in the same way by a cross-piece 15M which is guided on the frame 16, and are able to move on the latter, it being possible to adjust the position of the bearings 13M and 14M by thrust cylinders 17 which also supply the reaction force opposing the roll-separating force generated by the cast product.

In addition, the device includes means for measuring the position of the surface 34 of each roll. These measurement means include, for each roll, a set 20 of sensors 22 intended to measure the position of the surface 34 on a generatrix of this surface, lying in the horizontal plane P, diametrically opposite the neck, and at several points along this generatrix. In the drawing of FIG. 1, three sensors 22 have thus been shown, one lying in a vertical mid-plane $P_3$, and measuring the position of a point lying substantially in the middle of the said generatrix, the other two lying respectively in secondary vertical planes $P_1$ and $P_5$, near the edges of the casting surface 34. In order to increase the accuracy of the measurements, additional sensors, placed in intermediate positions, may be used.

The set 20 of sensors 22 is fixed with respect to the frame 16. The sensors are sensors of the type known in triangulation measurement applications, for example laser-beam sensors which are sensitive to small variations in distance while being remote from the point whose position it is desired to determine. These sensors 22 are arranged so as to be directed at the surface of the roll 11 through a window 18 made for this purpose in the cross-piece 15M for supporting the said roll. In this manner, the measurement made by these sensors is a direct measurement of the position of the targeted points on the surface of the roll 11 with respect to the frame 16, and is therefore independent of the position of the bearings 13M, 14M.

The means for measuring the position of the surface 34 also include a set 21 of sensors 23, lying beneath the roll 11 in a vertical plane passing substantially through the axis of the roll, this set being fixed with respect to the bearings 13M, 14M, and therefore moving with the latter. The sensors 23 are, for example, capacitive or inductive for close-up measurement. The set 21 includes three sensors 23 lying respectively in the same vertical planes as the sensors 22 of the set 20, which therefore allow three-point measurement of the position of the generatrix of the surface 34 lying at 90° from the neck, downstream of the latter with respect to the direction of rotation of the roll.

Likewise, two sets 24, 25 of sensors are arranged close to the second roll 10. However, given that the bearings 13F and 14F of this roll are fixed with respect to the frame 16, it will be noted that the sensors of the set 24 may then be also sensors of the capacitive or inductive type.

Figure 3:
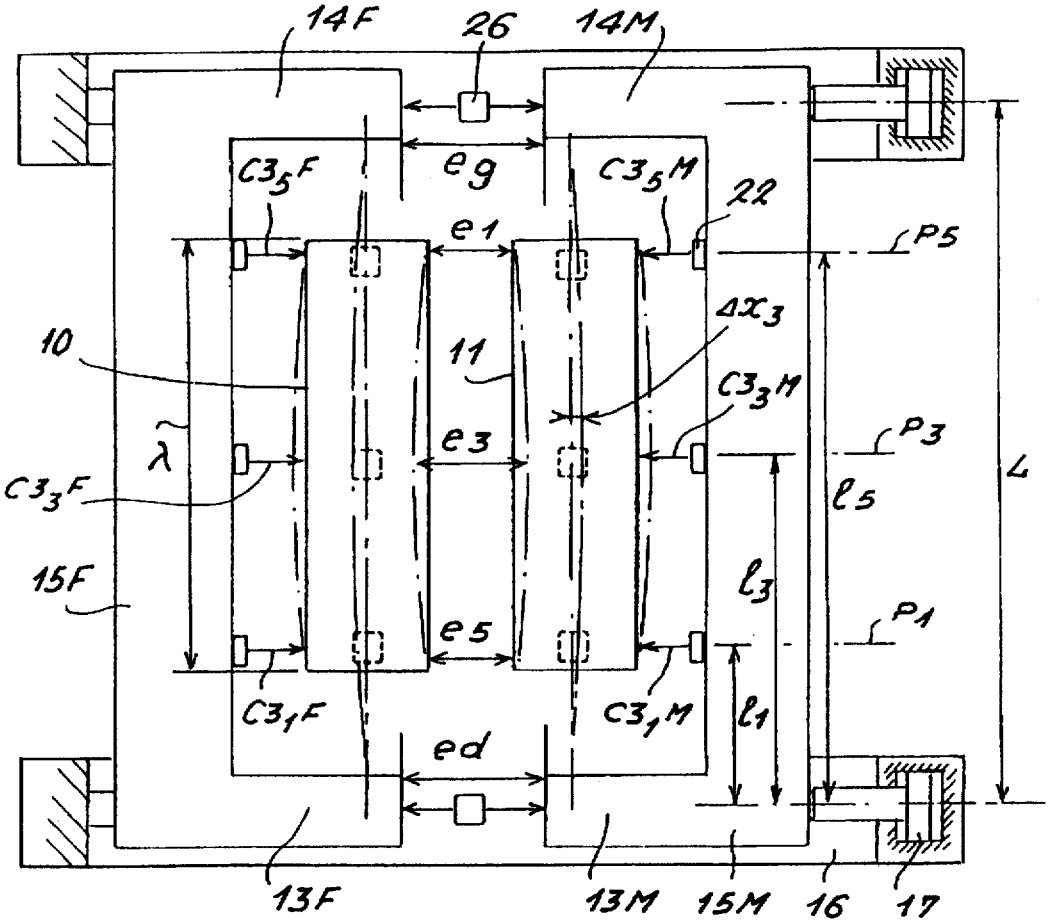
FIG. 3 is a simplified plan view of the device of the casting apparatus.
Figure 4:
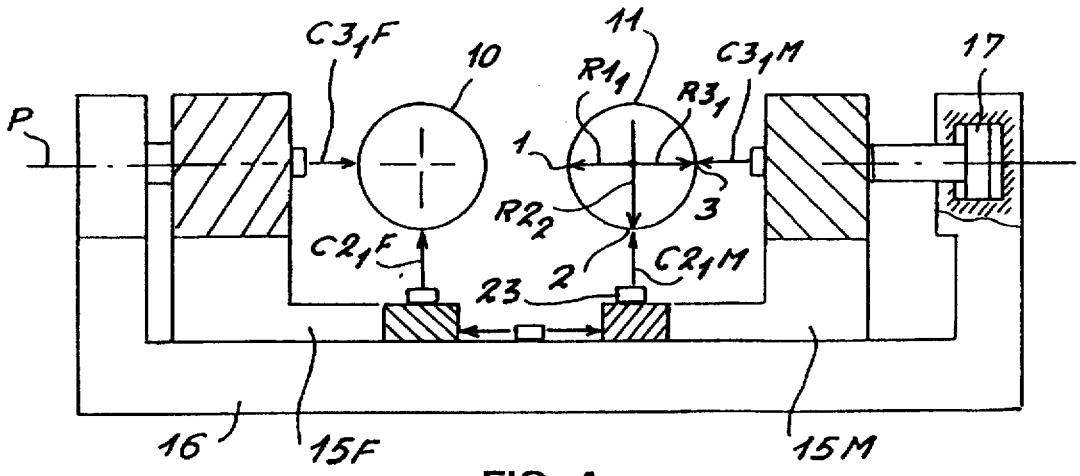
FIG. 4 is a front view of the device of FIG. 3, in section through the plane $P_1$ of FIG. 3.

According to an embodiment variant, shown in FIGS. 3 and 4, such sensors, capable of making measurements only at a short distance, may also be used instead of the sensors 22 in order to measure the position of the position of the points of the generatrix opposite the neck on the roll 11. In this case, these sensors are fixed with respect to the means 15M for supporting this roll, and additional sensors are provided to measure the position of these supporting means with respect to the frame, for example sensors 26 arranged so as to measure the variations in separation between the bearings of the two rolls.

The method of continuously determining the gap during casting, with the aid of measurements made by the aforementioned sensors, will now be described in relation to FIGS. 3 and 4.

Before doing so, it will be recalled that the actual gap at the neck between the rolls, during casting, depends on:

- the initial concavity of the rolls, when cold;
- the effect of the thermal crown and of the radial expansion of the shells, which effects tend to reduce this concavity as the shells heat up; and
- the spring in the set of members supporting the shells, especially the bending of the shafts of the rolls which tends to increase the distance between the rolls at the neck.

Bearing in mind the fact that the clamping forces are relatively low and that the diameter of the shell is large compared to its width, it may be considered that the shell itself does not bend, or at least that this bending is negligible. However, the inherent spring in the shell can be taken into account in the determination of the gap by using a larger number of sensors for each set of sensors.

The spring in the frame 16 may also be considered as being negligible. However, by using a sensor arrangement like that shown in FIGS. 3 and 4, the measurement becomes completely independent of this possible spring since what are measured are the variations in separation between the bearings of the rolls, the frame spring then no longer having an influence on the measurements.

Moreover, in order to know accurately the shapes and dimensions of the gap at the neck during casting, it is sufficient to know, at the neck:

- the gap at the centre, that is to say in the mid-plane of the installation;
- the dissymmetry of the gap;
- the surface profile of the shells.

Knowing these elements, it is possible to control:

- the thickness of the cast product, by commanding equal movements of the two clamping cylinders 17;
- the transverse dissymmetry of the product, by commanding differential movements of these cylinders; and
- the crown profile, by controlling the heat exchanges between product and shell, for example by varying the cooling of the shell or the rate of rotation of the rolls.

In the explanations which follow, in order to determine, using the measurements made by the various sensors, the value of the gap at the centre, the dissymmetry and the shape of the surface profile of the shells, the following notation will be used:

- eo: the value of the initial gap, when cold, between the theoretical generatrices 36 of the shells;
- e: the value of the actual gap;
- b: the value of the deflection, when cold, of the generatrix of the surface 34, resulting from the machining of this surface;
- Dx: the value of the spring in a roll;
- $e_d$ and $e_g$: the values of the variation in the separation between bearings, on each side of the rolls, measured by the sensors 26;
- DR: the variation in the length of the radius of the roll with respect to its length when cold (due to the effect of the thermal crown and of the radial expansion);
- δ: the variation in the length of the radius during rotation;
- L: the distance between the two bearings of a roll;
- l: the axial distance of each of the vertical planes containing the sensors, with respect to a bearing;
- l: the width of the shell;
- C: the values of the variations in position of each point on the shell, measured by the sensors 22, 23.

Moreover:

- the numbers 1, 2, 3 assigned to the above symbols indicate the angular position in which the value in question is considered: 1 indicates the location at the neck, 2 indicates the location at 90° to the neck and 3 indicates the location at 180° to the neck (diametrically opposite the neck);
- similarly, the numbers shown as indices indicate the axial location: 3 corresponding to the location in the mid-plane, and 1 and 5 corresponding respectively to the locations in the secondary planes, near the edges of the shells (it will be noted that the indices 2 and 4 would correspond to additional intermediate planes) ;
- the letter "F" indicates that the value relates to the fixed roll 10 and the letter "M" relates to the movable roll 11.

Thus, for example:

- $C2_3M$ is the value, measured by the sensor 23, of the variation in position of the point on the surface 34 of the shell of the movable roll 11, which point lies at 90° from the neck and in the mid-plane;

$\delta 23_1$ is the variation in the length of the radius, in the secondary plane $P_1$ lying near the edge of the shell, between the 90° location and the 180° location with respect to the neck.

Finally, it is convenient to assign the symbol "F/M" to the sum of the values corresponding to the same measurement or variation for each roll (thus, for example: $C2_3F/M=C2_3F+C2_3M$) and to assign the sign "+" to all the values corresponding to an increase in the gap and the sign "−" to those corresponding to a decrease in the gap.

It will be noted that the values of C, relative to the 90° position ("2" position) and used in the following formulae, are retarded by a time equivalent to one quarter of a revolution of the roll, so that the position variations taken into account in the same computation relate to the same generatrix, although the measurements of these variations are made in different angular positions, so as, in particular, to be free of any possible out-of-roundness of the rolls.

Given these notation conventions, the following equations may be written:

a) For the determination of the gap at the centre $e_3$

Spring in the shaft of a roll at the centre (in the mid-plane): $Dx_3=C3_3-(C2_3-\delta 23_3)$ Variation in radius at the neck: $DR_3=C2_3+\delta 12_3$ hence the actual gap at the centre:

| | |
|---|---|
| $e_3$ = initial gap | $eo_3$ |
| + hollowness of the rolls when cold | $+b_3F+b_3M$ |
| + shaft spring($Dx_3$) | $+C3_3F-(C2_3F-\delta 23_3F)$ $+C3_3M-(C2_3M-\delta 23_3M)$ |
| − $DR_3$ at the neck | $-(C2_3F+\delta 12_3F)$ $-(C2_3M+\delta 12_3M)$ |

hence:

$$e_3=eo_3+b_3F/M+C3_3F/M-2.C2_3F/M+\delta 23_3F/M-\delta 12_3F/M$$

The value of $\delta 23_3-\delta 12_3$ is small and may be determined by a computer model taking into account the casting parameters, especially heat-exchange flux and rate, for a given shell, or experimental values. It should also be noted that this value, according to the computer model, is virtually invariant with respect to the intensity of the cooling of the shell.

b): dissymmetry of the gap:

The end sensors lying near the edges and at 180° enable the dissymmetry to be known:

$$e_1=eo_1-b_1F/M+C3_1F/M-2.C2_1F/M+\delta 23_1F/M-\delta 12_1F/M$$

$$e_5=eo_5-b_5F/M+C3_5F/M-2.C2_5F/M+\delta 23_5F/M-\delta 12_5F/M$$

by definition, setting $b_1$ equal to $b_5$ (symmetry of the initial hollowed profile), then :

$$e_1-e_5=eo_1-eo_5+C3_1F/M-2.(C2_1F/M-C2_5F/M)+\underbrace{(\delta 23_1F/M-\delta 23_5F/M)}_{A}-\underbrace{(\delta 12_1F/M-\delta 12_5F/M)}_{B}$$

It may be assumed that the expressions $A=(\delta 23_1F/M-\delta 23_5F/M)$ and $B=(\delta 12_1F/M-\delta 12_1F/M)$ are substantially zero, since the conditions are in principle identical on each side of the rolls, and these are differences in substantially equal magnitudes.

Moreover, $eo_1$ and $eo_5$ have the following values:

$eo_1=ed-(ed-eg).1_1/L$ $eo_5=ed-(ed-eg).1_5/L$ hence:

$$(eo_1-eo_5)=[(ed-eg)/L].(1_5-1_1)$$

hence the value of the dissymmetry:

$$e_1-e_5=[(ed-eg)/L].(1_5-1_1)+C3_1F/M-C3_5F/M-2.(C2_1F/M-C2_5F/M)$$

c): Profile

It may be demonstrated that the inherent thermal crown profile of the surface 34 of each roll, which is added to the profile when cold, is of the form:

$$Y=K(Dq).[2.\ e^{-\beta(1/2)}-e^{-\beta(x)}-e_{-\beta(1-x)}].$$

β being a constant, it is necessary to compute K which is a function of the temperature gradient across the wall of the shell.

In order to take into account a possible defect in symmetry with respect to the mid-plane, it is necessary to know at least one point on the curve on each side and therefore it is necessary to have at least three sensors. By taking the average of the values measured by the sensors close to the edges, it will be possible to determine the profile of the roll with respect to its axis.

In the case where there are three sensors at 180° but only one sensor at 90°, it will be necessary to take the value of the crown at 180°. If there are at least 3 sensors at 90°, it will then be possible to take the value of the crown at 90° which, being closer to the neck, will have a value closer to that of the neck, and therefore the profile of the neck will be determined more accurately.

In order to know the profile at the neck from the 90° or 180° profile, it is necessary to integrate the variations in radius between the neck and the position where the crown is read:

therefore:

$$DR_i=C2_i-\delta 12_i$$

hence, if the crown is measured in the location at 90° from the neck:

$$Y_1=C2_3-C2_1+\delta 12_3-\delta 12_1$$

$$Y_5=C2_3-C2_5+\delta 12_3-\delta 12_5$$

The values of $\delta 12_3$ and $\delta 12_1$ and $\delta 12_5$, as previously stated, may be determined by means of a model, either as a function of the casting parameters or of the difference in the value of the crown between 180° and 90°, or by means of experimental curves or values.

Knowing $Y_1$ and $Y_5$, it is then possible to determine the profile of each roll at the neck.

As will have been understood, the device and the method according to the invention enable the actual gap between the rolls during casting to be determined accurately and continuously, by defining this gap by its value at the centre, its possible dissymmetry with respect to the mid-plane and the shape of the generatrix of each roll at the neck.

The sensor or sensors lying at 90° to the neck serve particularly to determine the influence of the variations in radius and in profile of the rolls due to the effects of thermal crown, since in this 90° location the deformations due to the mechanical effects of the cylinder-separating forces are negligible. It would therefore also be possible to make the corresponding measurements above the rolls at 90° upstream of the neck. However, for space-constraint reasons it is easier to place the sensors beneath the rolls. In addition, considering the thermal crown measurements, such a position is favourable, as the crown variations are less between the neck and the 90°-downstream location than between the neck and a location 90° upstream of the neck, since, between the latter two locations, the heating due to the molten metal coming into contact with the shell is more abrupt than the cooling which follows the separation of the cast strip from the surface of the roll.

The various measurements indicated hereinabove make it possible to determine the variations in the gap in service, with respect to the gap when cold, with no force on the rolls, these variations being caused both by the forces exerted during casting and by the thermal deformations of the rolls. It is therefore assumed that the shape of the profile of the rolls when cold is known. In practice, the equation for the curve of the cold profile, used by the apparatus for machining the profile of the rolls, has been derived from the shape of the desired generatrix profile when hot in order to have the gap profile compatible with the desired breadth profile of the strip formed (this shape being defined by a mathematical function), this equation for the profile when cold giving the depth of the profile at a point as a function of the axial position of this point. Reciprocally, knowing the gap profile when cold by measuring the value of the gap at the centre and using the equation for the profile when cold, and knowing the variations in position and in shape for each roll, as mentioned hereinabove, it is possible to know the gap profile when hot with sufficient accuracy.

In the foregoing, it was considered that the shape of the profile of a generatrix of the roll was a curve defined by a mathematical function, the measurements made by the sensors lying in the three planes $P_1$, $P_3$, $P_5$ making it possible to define the parameters of this curve and its position in the installation. It will be easily understood that, if a large number of sensors can be used in planes parallel to $P_3$, in addition to the planes $P_1$ and $P_5$, that is to say distributed over the width of the face of the roll, of surface 34, it will then be possible to know, directly by measurement, the position of several points on the profile and therefore to know accurately the profile of the rolls and therefore the gap, without it being absolutely necessary to know the shape of the initial profile.

It goes without saying that the invention applies not only to continuous casting but also, as already mentioned at the beginning, to the rolling of flat products made of metal or some other material.

We claim:

1. Method of continuously determining properties of a gap between necks of two rolls of an installation for hot-shaping a thin metal product by passing the product between said rolls, said rolls having substantially parallel axes such that the gap lies in a plane passing through the axes and through the necks of the rolls, said method comprising: measuring a value of a thickness of the gap at a center of the roll lying in a transverse mid-plane of the installation in an initial state of the installation without the product and when the installation is cold; and, during shaping of the product, and for each said roll:

measuring variations in position with respect to said initial state of at least three points on a surface of the roll, along a generatrix lying at 180° to the neck, said points lying respectively at least in said mid-plane and in two secondary planes parallel to the mid-plane and lying on either side of said mid-plane;

measuring a variation with respect to this initial state, of a position of a point lying on a generatrix lying at 90° to the neck;

determining variations in a length of a radius of the roll in each of the mid-plane and the secondary planes, between the neck and one of said generatrices, using one of a computer model and experimental curves;

computing, using the measurements of the variations in position of the points in the mid-plane and lying respectively at 90° and 180° with respect to the neck, and using determined variations in radius length in the mid-plane, between the neck and the 90° location ($\delta 12_3$) and between the 90° and 180° locations, 1) a value of a roll spring at the center and 2) a value a variation in a length of a radius at the neck with respect to the initial state;

and computing, using the value of the gap at the center when cold and the computed value of the roll spring at the center and the computed value of the variation in the length of the radius, an instantaneous value of the thickness of the gap at the center, as well as a profile of the gap.

2. Method according to claim 1, further comprising measuring variations in positions of points which lie in the secondary planes and at 90° to the neck.

3. Method according to claim 1, further comprising determining a thermal profile of a generatrix remote from the neck, and at a location where variations in position of at least three points of this generatrix are measured, using a parametrized function defining a thermal deformation at a first point on the generatrix as a function of the axial position of said first point and using the measurements of the variations in the position of the at least three points, and determining a thermal profile of the generatrix at the neck using the thermal profile of the generatrix remote from the neck and using the determination of the variations in the lengths of the radii of the roll, in the mid-plane and in the secondary planes, between the neck and the location of the said generatrix remote from the neck.

4. Method according to claim 2, further comprising determining a dissymmetry ($e_1$–$e_5$) of the gap using a measurement of variations in position of the points lying in the secondary planes and in the 90° and 180° locations.

5. Method according to claim 1, further comprising measuring variations in position of points lying at 180° with respect to a reference fixed in space.

6. Method according to claim 1, further comprising measuring 1) variations in position of points lying at 180° to respective means for supporting the rolls, said means including bearings in which ends of shafts of the rolls rotate, and 2) variations in a separation of the bearings at each of the said ends.

7. Device for shaping thin metal products, said device comprising 1) two rolls having substantially parallel axes defining between them a gap lying in a common plane of their axes, each of said rolls having a neck that lies in the gap; 2) supports including bearings in which axial ends of shafts of the rolls rotate; 3) a frame on which the bearings for at least one of the rolls is guided and can move translationally in a direction in which the rolls are moved closer together or further apart; 4) first means for measuring a position of a generatrix diametrically opposite the neck of each roll, said first means for measuring monitoring at least at three points located respectively in a mid-plane perpendicular to the axes and in two secondary planes parallel to the mid-plane and lying near edges of the rolls; 5) second means for measuring a position in the mid-plane, of a generatrix lying at 90° to the neck; 6) means, responsive to said first and second means for measuring, for computing an instantaneous value of a thickness of the gap at the center, as well as a profile of the gap; and 7) means, responsive to said means for computing, for moving the frame to move one of the rolls translationally with respect to the other of the rolls to maintain a constant gap thickness.

8. Device according to claim 7, further comprising means for measuring a position, in the secondary planes, of the generatrix lying at 90° from the neck.

9. Device according to claim 7, wherein said first and second means for measuring are position sensors attached to said means for supporting the rolls, and further comprising means for measuring variations in a separation of said bearings.

10. Device according to claim 7, wherein said first means for measuring comprises sensors attached to the frame.

11. Device according to claims 7, wherein said rolls are cooled casting rolls of an installation for continuous casting between rolls.

12. Device according to claim 7, further comprising computation means, connected to the said measurement means (22, 23), for:

computing variations in measured positions of the generatrices;

determining, by means of at least one of 1) a computer model taking into account the casting parameters, and 2) experimental data, variations in the length of a radius of the roll in each of the planes, between the neck and one of the 90° and the 180° locations;

computing, using the position variations and the variations in length of the radius, a value of a roll spring at a center of the roll and a value of a variation in a length of a radius at the neck with respect to an initial state;

and deducing therefrom 1) the instantaneous value of the thickness of the gap at the center and 2) the profile of the gap, using a) a value of the thickness of the gap at the center when the installation is cold and b) the value of the roll spring at the center and c) the value of the variation in the length of the radius.

13. Device according to claim 7, wherein said first and second means for measuring comprise capacitive or inductive or laser-beam sensors.

14. A device for shaping thin metal products; said device comprising:

a frame;

first and second rolls rotatably mounted on said frame, said first and second rolls having parallel axes lying in a common plane, each of said rolls having a neck located in said common plane, a gap being formed between the necks of said first and second rolls and lying in said common plane, each roll having a first generatrix located diametrically opposite the neck and a second generatrix lying at an angle of 90° from the neck;

for each of said first and second rolls:

a set of sensors which measure a position of the first generatrix of said roll, said first set of sensors including 1) a first sensor measuring a position of a first point of said first generatrix lying in a mid-plane extending perpendicularly to said axes of said rolls and located mid-way between opposed edges of said roll, and 2) second and third sensors measuring positions of second and third points of said first generatrix lying in first and second secondary planes, said first and second secondary planes being parallel to said mid-plane and being located near said opposed edges of said roll, a fourth sensor which measures a position of a first point on said second generatrix lying in said mid-plane, and means, responsive to said first, second, third, and fourth sensors, for computing an instantaneous value of a thickness of the gap at a center of the roll, as well as a profile of the gap; and means, responsive to said means for computing, for driving said second roll to move translationally with respect to said first roll so as to vary a thickness of said gap.

15. A device according to claim 14, further comprising, for each of said first and second rolls, fifth and sixth sensors which measure positions of second and third points on said second generatrix, said second and third points on said second generatrix lying in said first and second secondary planes, respectively.

16. A device according to claim 14, wherein said means for computing comprises means for:

(A) computing variations in positions of said first generatrix and said second generatrix, (B) determining variations in a length of a first radius of said roll in said mid-plane and of second and third radii of said roll in said first and second secondary planes, (C) computing, using 1) computed variations in the positions of said first generatrix and of said second generatrix and 2) determined variations in the lengths of the first, second, and third radii, a first computed value and a second computed value, said first computed value being a value of a roll spring at a center of said roll, said second computed value being a value of a variation in a length of a radius of said roll at the neck with respect to an initial state of said radius of said roll at the neck, and (D) deducing, from 1) said first computed value and said second computed value and from 2) known initial values of a thickness of a longitudinal center of said gap and of the roll spring rate, 1) the instantaneous value of the thickness of said gap at the longitudinal center of said gap and 2) the profile of said gap.

* * * * *